United States Patent [19]

Murphy

[11] Patent Number: 4,790,679

[45] **Date of Patent: * Dec. 13, 1988**

[54] POWER PAINT BRUSH WITH FLOW RESTRICTOR AND REMOVABLE BRUSH HEAD

[75] Inventor: Edward P. Murphy, Coon Rapids, Minn.

[73] Assignee: Graco Inc., Minneapolis, Minn.

[ * ] Notice: The portion of the term of this patent subsequent to Jun. 30, 2004 has been disclaimed.

[21] Appl. No.: 116,011

[22] Filed: Oct. 30, 1987

[51] Int. Cl.[4] ..... A46B 11/02; A46B 11/06

[52] U.S. Cl. ..... 401/146; 401/149; 401/270; 401/277; 401/285; 401/287; 401/288; 401/289; 401/290

[58] Field of Search ..... 401/285, 287, 288, 286, 401/290, 289, 277, 270, 265, 146, 149, 280, 281

[56] References Cited

U.S. PATENT DOCUMENTS

| | | | |
|---|---|---|---|
| 1,335,671 | 3/1920 | Dunn | 401/287 |
| 1,424,478 | 8/1922 | Horvath | 401/289 |
| 3,284,838 | 11/1966 | Bieganowski | 401/286 X |
| 3,748,049 | 7/1973 | Knapfer et al. | 401/289 |
| 4,516,591 | 5/1985 | Herholzer | 401/265 X |
| 4,676,685 | 6/1987 | Murphy | 401/285 |

FOREIGN PATENT DOCUMENTS

| | | | |
|---|---|---|---|
| 28394 | 8/1930 | Australia | 401/288 |
| 547433 | 10/1957 | Canada | 401/288 |
| 291110 | 4/1916 | Fed. Rep. of Germany | 401/290 |
| 414540 | 12/1966 | Switzerland | 401/277 |
| 1321670 | 6/1973 | United Kingdom | 401/290 |

*Primary Examiner*—Steven A. Bratlie
*Attorney, Agent, or Firm*—Douglas B. Farrow

[57] ABSTRACT

A pressure-fed brush may be used for efficient painting. The elastomeric bladder member inside the brush member is provided with a plurality of slots which separate the pressure-fed V-slots into separate fingers, thereby allowing flexing over irregular surfaces. A flow control restrictor is also provided to allow the flow fed to the brush to be varied according to the nature and viscosity of the materials being used. By providing such a flow controller, the need to feather or otherwise modulate the valve at the brush is removed. The handle and valve assembly may be utilized with different size brush heads by provision of different intermediate members which retain varying size bladders for use with varying size brush members.

4 Claims, 2 Drawing Sheets

POWER PAINT BRUSH WITH FLOW RESTRICTOR AND REMOVABLE BRUSH HEAD

BACKGROUND OF THE INVENTION

Power-fed brush coating apparatuses are well-known and are typified by that shown in my prior U.S. Pat. No. 4,676,685 and the other patents referred to and cited therein as well as those cited during the prosecution thereof. While such devices work well, it is desired to improve upon the functions disclosed in those patents.

SUMMARY OF THE INVENTION

The contents of the aforesaid U.S. Pat. No. 4,676,685 are hereby incorporated by reference. The bladder member is provided with a number of slots which are parallel to, located between and longer than the V-shaped slots mentioned in the aforesaid patent. Such elongated slots allow the formation of "fingers" on the bladder which allows the bladder to more easily conform to irregular surfaces and provide improved distribution of the paint or other coating material through the brush member.

When utilizing various types of coating materials from stains to latexes and the like, the highly-varying viscosities and other fluid qualities require careful operator action with the aforesaid patent to provide consistent flow; that is, the valve must be feathered or varied in order to apply the proper amount of material, particularly when the pump bladder and the like have been sized for relatively viscous materials and a thin material such as a stain is used. It is therefore desired to provide a flow restrictor which will account for variations in pressure and which will provide a consistent flow rate depending on the application desired.

Toward that end, a flow restrictor assembly is provided having two flow washers therein. All of the flow through the assembly is directed through a first flow washer while a non-varying proportion of the total flow may be directed through a second flow washer. Thus, when the second flow washer is totally by-passed, a maximum amount of flow is available and as the by-passed flow is directed to the second flow washer, the total flow is decreased as all the flow is directed through both washers, a minimum flow may be obtained. Due to the nature of the assembly, the minimum and maximum flows are easily changed to account for varying materials and/or varying size brushes.

An intermediate member is provided which sandwiches the bladder into a handle such that the brush member itself is not required to do any sealing against pressure and need only cope with the paint which exits the bladder member at near atmospheric pressure. By doing so, the brush member is easily removed and washed and, indeed, the bladder assembly itself is easily flushed as well. The intermediate member is easily removed from the handle along with the bladder and different size intermediate member and bladder may be substituted for trimming or the like where a narrower or otherwise different size brush may be desired. The brush member is clipped to the intermediate member by clips similar to those utilized with automotive distributors.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
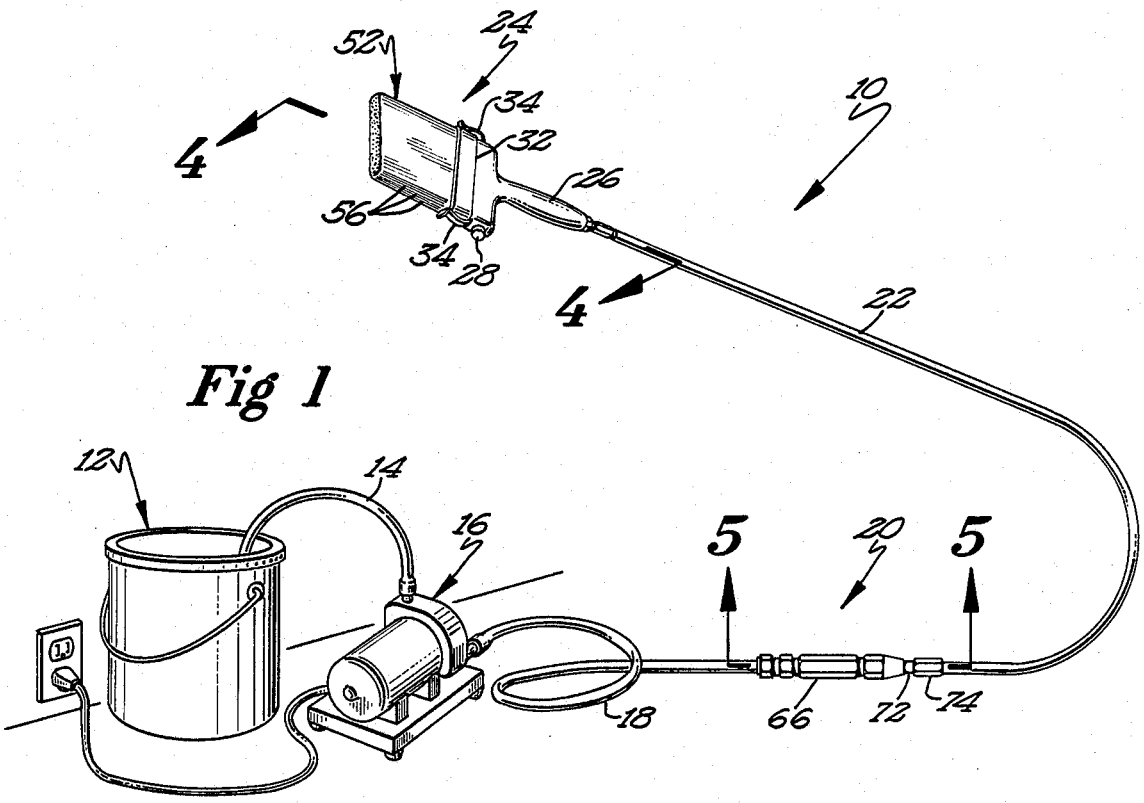
FIG. 1 is a perspective view showing the power brush system of the instant invention.
Figure 3:
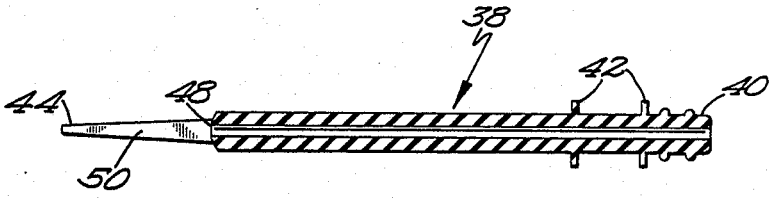
FIG. 3 is a sectional view taken along Line 3—3 of FIG. 2.

The invention shown generally in FIG. 1 and designated 10 is designed for use with a bucket or other container 12 of paint or other coating material. An inlet hose 14 leads to a pump 16 which in turn feeds a main hose 18. Pump 16 is capable of producing pressures up to 250 psi, which allows the use of long hoses 18, thereby providing increased versatility in use. A flow restrictor assembly 20 is attached to the end of main hose 18 and in turn has a whip hose 22 attached between restrictor assembly 20 and brush unit 24.

Figure 4:
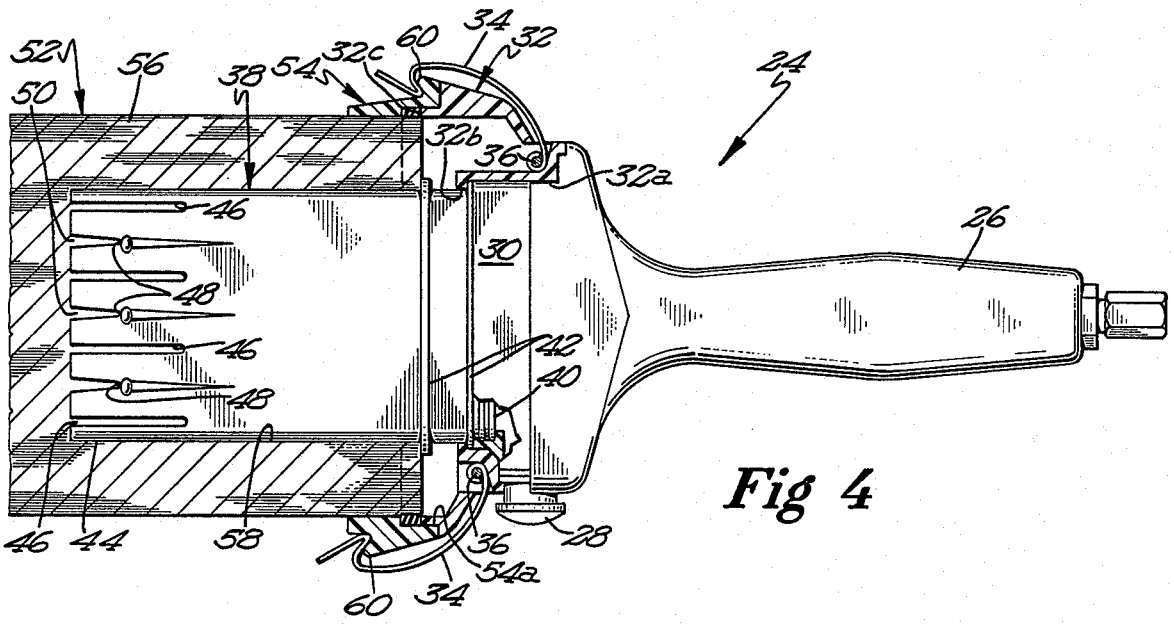
FIG. 4 is a sectional view taken along Line 4—4 of FIG. 1.
Figure 2:
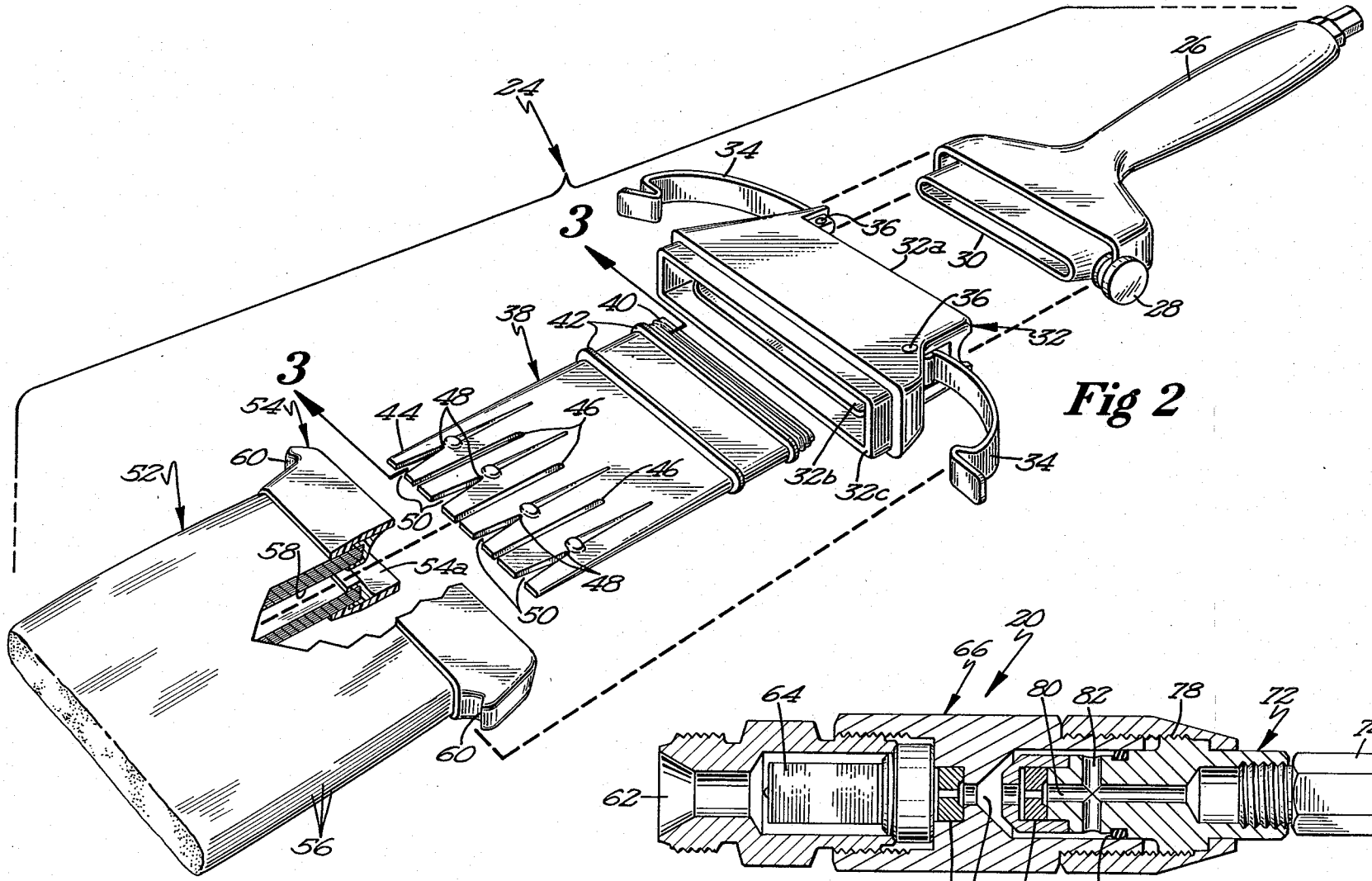
FIG. 2 is an exploded view showing the brush assembly itself.

Brush unit 24 is shown in more detail in FIGS. 2 and 4 is comprised of a handle 26, having therein a valve 28 and an attachment flange 30. An intermediate member 32 is attachable to handle member 28 by means of screws or the like (not shown). Intermediate member 32 has an opening 32A therein for receiving flange 30 and an opening 32B for seating and retaining the ridge 42 of bladder 38, as well as a flange 32C for receiving the brush member 52. Spring clips 34 are pivotally retained in place by pins 36 and are made and act similar to those clips used in automotive distributors for retaining brush head 52.

Bladder 38 is provided with a ribbed end 40 which is received in opening 30 of handle 26. A rib 42 is held in place by flange 32B of intermediate member 32 to provide the pressure interface and retain the pressurized fluid in the handle 26 and bladder 38.

Bladder 38 further has a plurality of slots 46 which are located intermediate to passage ends 48 which terminate in small V-shaped slots 50.

Brush head 52 is provided with a solid plastic or the like head 54 having a plurality of bristles 56 potted therein. A central passageway 58 is provided in brush head 52 for the bladder to pass there-through. Lips 60 are provided on the exterior of brush head 54 for attachment of clips 34.

Figure 5:
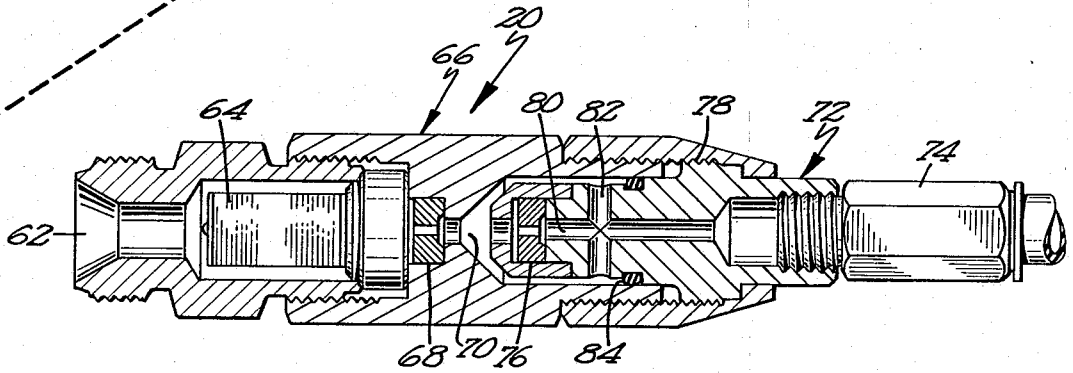
FIG. 5 is a sectional view taken along Line 5—5 of FIG. 1.

Restricter assembly 20 is comprised generally of a valve inlet 62 and a filter 64 located in main body 66. A first restrictor 68 receives all of the flow passing through restrictor 20 while a passage 70 leads from the exit of first restrictor 68 to a variable orifice which may be controlled by screwing moveable portion 72 in and out. An outlet 74 is located at the other end of moveable portion 72 which has adjacent to area 70 a second restrictor 76 which may receive a portion of the flow passing through restrictor assembly 20, depending on the position it is located in. As shown in FIG. 5, second flow restrictor 76 is essentially by-passed as flow will pass from area 70 through passage 82 and into outlet member 74. When it is desired to restrict the flow, moveable portion 72 is screwed inwardly, thereby moving restrictor 76 to the left closing passage 70 and forcing bypass of flow through second restrictor 76 and thence through passage 80. As the conical portion at the left end of moveable portion 72 approaches and contacts body 66, all flow will be forced through both restrictors and a minimal amount of flow will be obtained. Threads 78 allow the relative movement of moveable portion 72 and body 66 while a seal such as in O-ring 84 provide sealing.

Flow restrictors 68 and 76 are of the type generally known as flow washers and may be appropriately sized to provide the desired flows.

It is contemplated that various changes and modifications may be made to the power brush without departing from the spirit and scope of the invention as defined by the following claims.

What is claimed is:

1. A pressure-fed brush coating applicator having a handle, a valve in said handle, a flexible bladder member having fluid passages terminating in V-slots and a brush member, the improvement comprising:

an intermediate member removeably attached to said handle, said bladder member comprising a first end and a ridge adjacent said bladder first end, said ridge being captured between said handle and said intermediate member and said bladder first end being in fluid communication with said handle;

a valve located in said handle; and means for releasably clipping said brush member to said intermediate member, said brush member being removeable from said intermediate member while leaving said bladder attached to said intermediate member and without the release of fluid from said handle.

2. A pressure-fed brush coating applicator having a pump, at least one hose section, a handle, a valve in said handle, a flexible bladder and a brush member, the improvement comprising a flow restrictor assembly located intermediate said pump and said handle, said restrictor being operable to vary the flow between first and second predetermined flow rates and comprising:

first and second flow restrictors wherein all flow through said assembly passes through said first restrictor and a reduced proportion of said flow may be directed through said second restrictor when in series with said first restrictor.

3. The applicator of claim 2 wherein said restrictors comprise flow washers.

4. The applicator of claim 2 wherein said restrictor assembly is connected to said handle by a whip hose.

* * * * *